US005562477A

United States Patent [19]

Moore et al.

[11] Patent Number: 5,562,477

[45] Date of Patent: Oct. 8, 1996

[54] HIGH VIBRATION ELECTRICAL CONNECTOR

[75] Inventors: Michael E. Moore, Morton, Ill.; Jeffrey R. Albers, Yucaipa, Calif.

[73] Assignee: Caterpillar Inc., Peoria, Ill.

[21] Appl. No.: 333,456

[22] Filed: Nov. 2, 1994

[51] Int. Cl.[6] ..... H01R 4/38

[52] U.S. Cl. ..... 439/383; 439/596

[58] Field of Search ..... 439/382–384, 439/271–275, 596

[56] References Cited

U.S. PATENT DOCUMENTS

| | | | |
|---|---|---|---|
| 2,659,061 | 11/1953 | Mirabella | 439/383 |
| 3,980,878 | 9/1976 | Crompton | 439/384 |
| 4,501,462 | 2/1985 | Fidi | 439/382 |
| 4,891,021 | 1/1990 | Hayes et al. | 439/599 |
| 4,900,271 | 2/1990 | Colleran et al. | 439/595 |
| 4,902,247 | 2/1990 | Suzuki et al. | 439/595 |
| 4,971,580 | 11/1990 | Ward et al. | 439/595 |
| 4,973,268 | 11/1990 | Smith et al. | 439/595 |
| 4,998,896 | 3/1991 | Lundergan | 439/595 |
| 5,281,168 | 1/1994 | Krehbiel et al. | 439/595 |

FOREIGN PATENT DOCUMENTS

| | | | |
|---|---|---|---|
| 405226035 | 9/1993 | Japan | 439/382 |

*Primary Examiner*—David L. Pirlot
*Attorney, Agent, or Firm*—R. Carl Wilbur

[57] ABSTRACT

The present invention relates to a high vibration electrical connector. Included in the connector is a receptacle that is preferably integral with a surface of an electrical component. The receptacle includes a securing wedge and an electrical pin. Also included in the electrical connector is a vibration dampening pad and a plug. The plug includes a fastening bar and a securing notch that engages with the securing wedge when said plug is inserted in said receptacle. The plug also includes a plug cap 105 to help seal the plug from external contaminants.

8 Claims, 4 Drawing Sheets

HIGH VIBRATION ELECTRICAL CONNECTOR

TECHNICAL FIELD OF THE INVENTION

The present invention relates to electrical connectors, and more particularly, to electrical connectors used in a high vibration environment.

BACKGROUND OF THE INVENTION

Internal combustion engines and other high vibration environments are increasingly using electrical components to perform control functions and other tasks. Those electrical components must be interconnected with electrical conductors or wires that run throughout the engine compartment environment. Those wires are typically exposed to wide ranges of temperature, moisture, oil, vibrations and other conditions that might cause damage. As microprocessors are increasingly used to control internal combustion engines, the number of electrical components within the engine compartment will increase, thereby increasing the number of wires exposed to the engine compartment environment.

To facilitate easy installation and removal, electrical components are generally connected to the wiring by an electrical connector. The electrical connector is connected to the wiring which in turn is connected to the other various electrical components. The electrical connector generally includes a plug and a receptacle which permits the electrical connection to be formed between the electrical component and the engine electrical circuitry. The plug includes individual sockets which are electrically connected to the wiring harness. The receptacle may be molded to an exterior surface of the electrical component and generally includes pins that are connected to the internal circuitry of the electrical component. When the plug is inserted into the receptacle, the pin engages with the socket to form an electrical connection between the component and the wiring harness.

One particularly harsh environment for electrical connectors involves fuel injectors. Such connectors are generally exposed to large variations in temperature and are exposed to significant vibrations. Vibrations can cause small movements between the pin and socket of an electrical connector. Over time, those movements can enlarge the socket opening and decrease the diameter of the pin, among other things. The vibrations may degrade the electrical connection and in some cases could break the connection altogether. Vibration damage is even more likely when the vibrations occur at approximately the same frequency as the natural frequency of the electrical connector.

Another problem with known connectors is that the entire plug portion of the connector must be discarded if a single socket is damaged.

There are some electrical connectors known in the art that permit a component to be easily replaced by simply disconnecting the component from the circuit using electrical connector. An example of such known connectors are disclosed in U.S. Pat. Nos. 4,902,247 and 4,971,580. Some electrical connectors have been designed to be used in a vehicle application. For example the electrical connector disclosed in U.S. Pat. No. 4,900,271 is used with a fuel injector.

However, none of the prior art recognizes these problems associated with vibration nor does the prior art disclose a solution.

An object of a preferred embodiment of the present invention is to provide an electrical connector that can withstand vibration.

Still another object of a preferred embodiment of the present invention is to provide an electrical connector in which the natural frequency of the connector can be easily modified to a frequency that is different from the vibration frequencies produced by the operating environment.

Another object of the present invention is to provide an electrical connector having a plug in which the socket can be readily and easily removed and replaced.

Yet other objects and advantages of the present invention will become apparent upon reading the detailed description of the preferred embodiment in connection with the drawings and appended claims.

SUMMARY OF THE INVENTION

The present invention is directed toward an electrical connector having a receptacle, a plug, and a vibration dampening pad. In an embodiment of the invention, the plug includes a replaceable socket, a plug sealer, and a fastening bar. The fastening bar includes a securing wedge that engages with a securing notch when the plug is inserted in the receptacle. The receptacle preferably includes an electrical pin that connects to the socket to form an electrical connection between the plug and the receptacle.

DETAILED DESCRIPTION OF A PREFERRED EMBODIMENT

The following is a detailed description of the best mode of an embodiment of the present invention. Throughout the various drawings like reference numbers are used to reference like parts. The present invention is not limited to the single embodiment described herein. To the contrary, the present invention encompasses all embodiments and equivalents as may fall within the scope of the appended claims.

Figure 1:
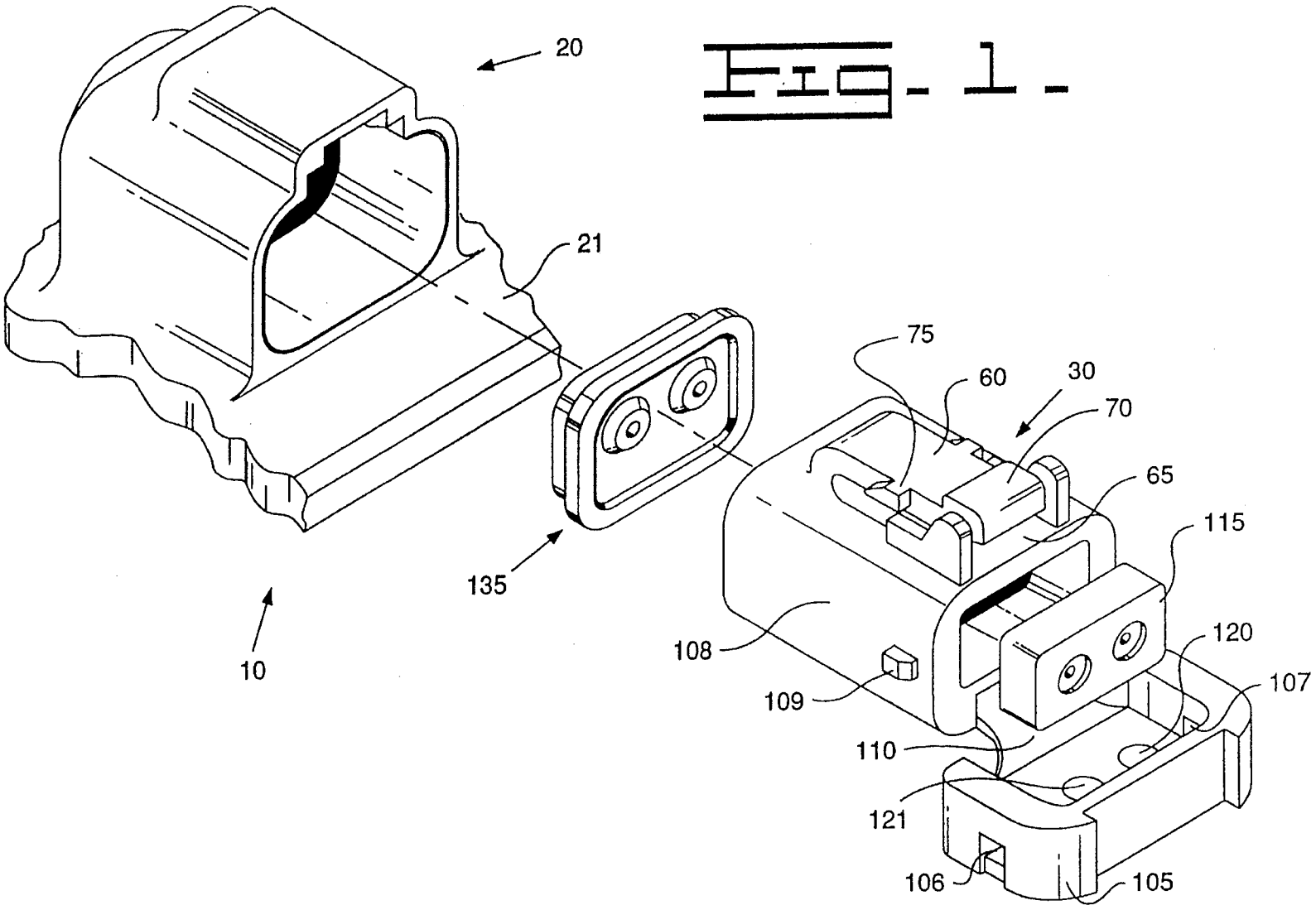
FIG. 1 shows an exploded isometric view of a preferred embodiment of the electrical connector of the present invention.

FIG. 1 shows an exploded isometric view of a preferred embodiment of the invention. As shown in FIG. 1, the electrical connector 10 includes a receptacle 20 and a plug 30. The receptacle 20 is preferably integral with an outer surface 21 of an electrical component (not shown) to which the connection is made. In other embodiments, the receptacle 20 may be a distinct part that is attached to the outer surface 21.

The plug 30 includes a cantilevered fastening bar 60 which can be moved toward an inner plug wall 65 by pressing a tab 70 of the fastening bar 60. The cantilevered fastening bar 60 is normally biased toward a first position shown in FIG. 1. The fastening bar 60 includes a securing notch 75 for engagement with a securing wedge (described below with reference to FIG. 3) in the receptacle 20 to hold the plug 30 within the receptacle 20. The plug 30 can be withdrawn from the receptacle 20, by pressing the tab 70 to disengage the securing notch 75 from the securing wedge and pulling the plug 30 out of engagement with the receptacle 20.

Also included in the plug 30 is a plug cap 105 which is preferably connected to the plug 30 by a hinge 110 formed from part of the plug 30. The plug cap 105 includes a first and second opening 120, 121 through which wires are inserted. The plug cap 105 aides in keeping oil or other contaminants from contacting the internal electrical connections within the electrical connector 10. Included on the plug cap 105 are first and second retaining notches 106, 107. The plug cap 105 is movable from a first position shown in FIG. 1, to a second position (shown in FIG. 2) in which the plug cap 105 is engaged with the plug body 108. In the second position, the first and second retaining notches 106, 107 engage with first and second retaining tabs 109, 111 to hold the plug cap 105 securely in the second position. As is described more fully below, when the plug cap 105 is in the second position, the internal components of the electrical connector are better protected from oil or other contaminants present in the operating environment.

In applications such as electrical connections on an internal combustion engine, the electrical connector is often exposed to significant vibrations. The frequency of the vibrations are a function of many factors, one of which is the rotational speed of the engine. Those vibrations are potentially damaging to the connector, especially if the frequency of the vibration is approximately the same as the natural frequency of the electrical connector. If those vibrations are left undampened, they may, over time, degrade the electrical connection formed by the connector. A preferred embodiment of the present invention, however, includes a vibration dampening pad 135. The vibration dampening pad is described more fully below.

Figure 2:
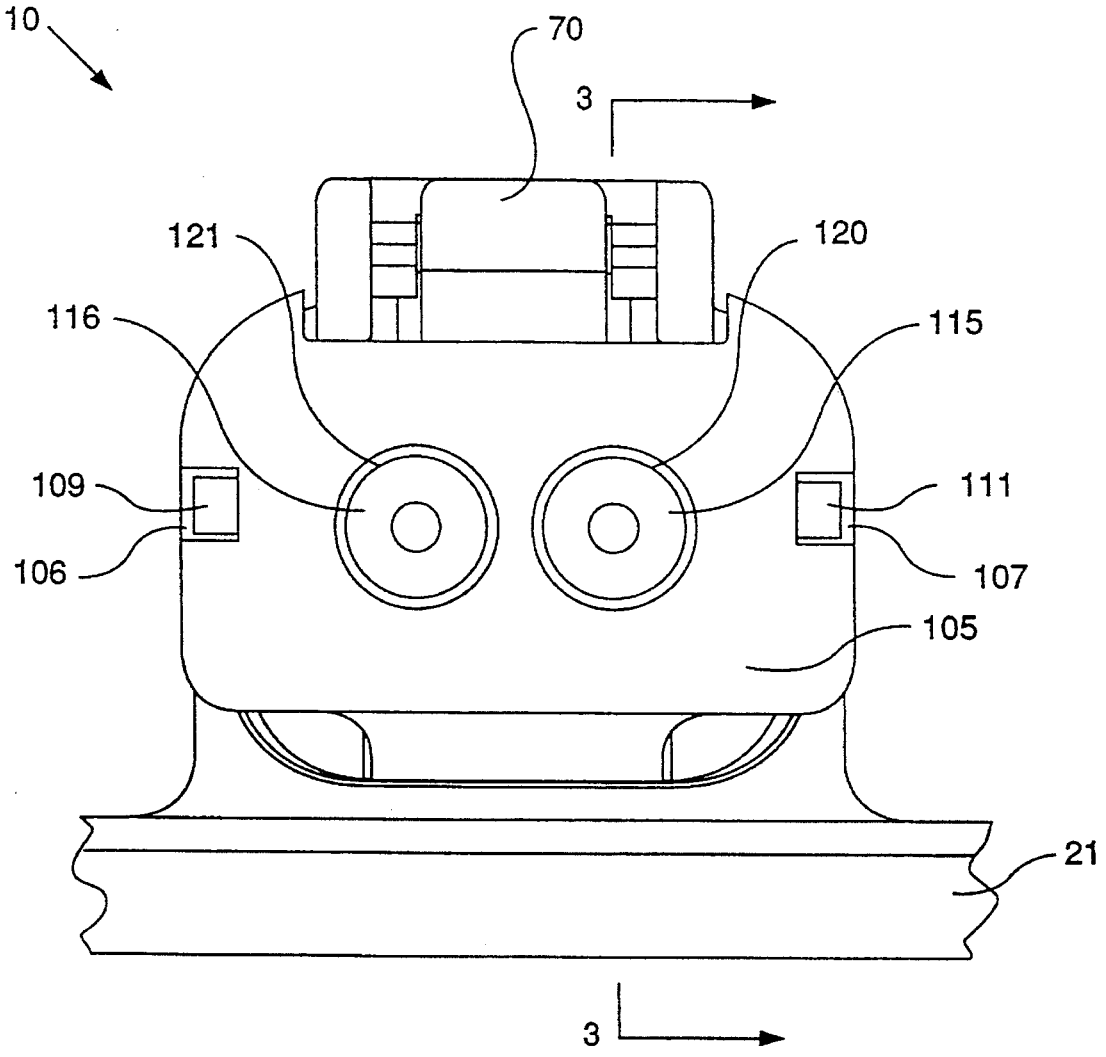
FIG. 2 shows a front view of a preferred embodiment of the electrical connector of the present invention.

FIG. 2 shows a front view of a preferred embodiment of the electrical connector 10 of the present invention. As shown in FIG. 2, the plug 30 is installed in the receptacle 20. The plug cap 105 is shown in the second position with the first and second retaining notches 106, 107 engaged with first and second retaining tabs 109, 111. The first and second openings 120, 121 are shown. Also shown are first and second grommets 115, 116 through which a wire is inserted. The grommets are discussed more fully below.

Figure 3:
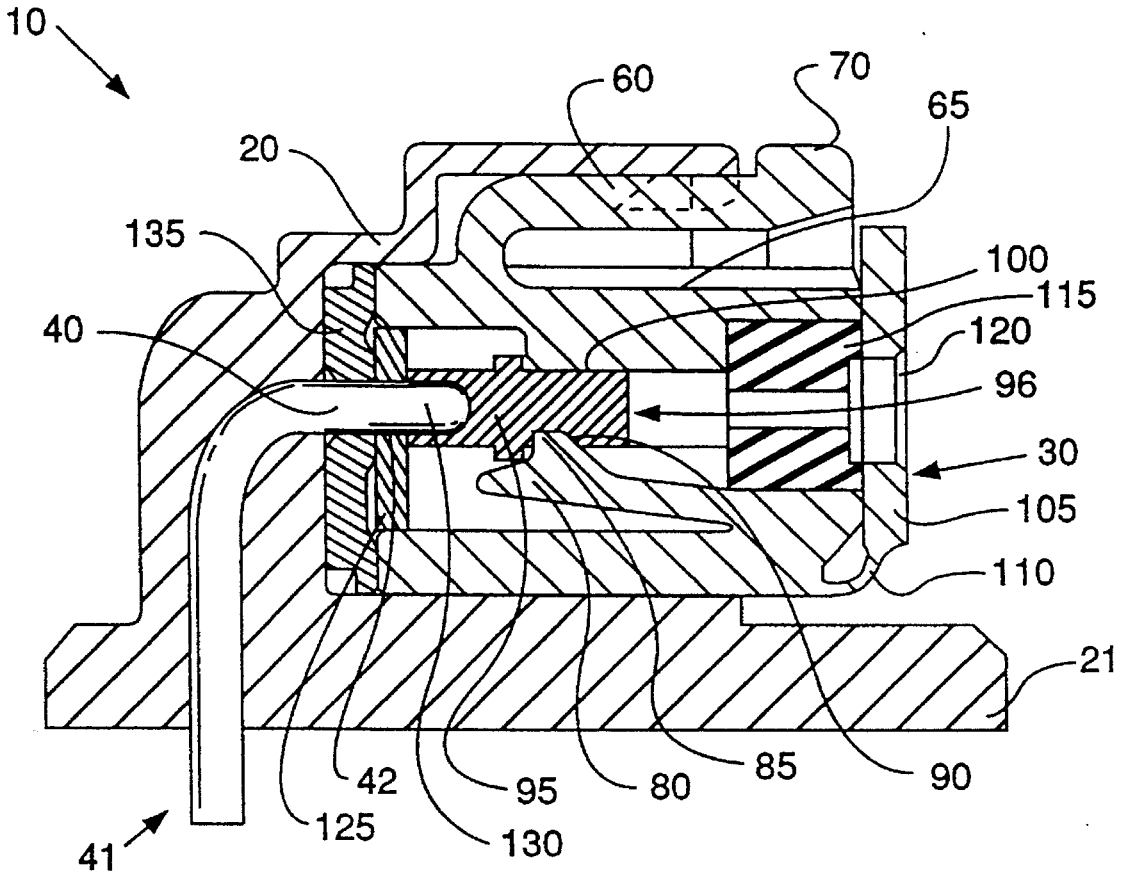
FIG. 3 is a cross sectional view taken along line 3—3 of FIG. 2.

FIG. 3 is a cross sectional view of the embodiment shown in FIG. 2, taken along section lines 3—3. As shown in FIG. 3, the electrical connector 10 includes a receptacle 20 and a plug 30. Integral with the receptacle 20 is an electrical pin 40. The receptacle 20 is preferably integral with an outer surface 21 of an electrical component (not shown) to which the electrical connection is made. In some applications, however, the receptacle 20 may be a distinct component and physically attached to the outer surface 21 of the electrical component. A first end 41 of the electrical pin 40 is connected to internal circuitry (not shown) of the electrical component. The electrical pin 40 is preferably bent, with a second end 42 engaged with a socket 95.

The plug 30 includes a cantilevered fastening bar 60 which can be moved toward an inner plug wall 65 by pressing a tab 70 on the fastening bar 60. As shown in FIG. 1, the fastening bar 60 includes a securing notch 75. The securing notch 75 is shown in phantom in FIG. 3, engaged with a securing wedge 50 on the receptacle 20.

The plug 30 preferably includes a forcing member 80 having a socket holding tab 85 integral therewith. The socket holding tab 85 is adapted to engage a slot 90 formed in the socket 95. The forcing member 80 is biased against the socket 95 to hold the socket 95 against a second interior plug wall 100. The socket 95 is also connectable with an exterior wire or electrical conductor (not shown) that is electrically engaged with an end 96 of the socket. In this manner, the socket 95 is adapted to engage with the electrical pin 40 to permit electrical current to flow between the internal circuitry of the electronic component, the electrical pin 40, the socket 95 and exterior wiring harness which is connected to other electrical components in the circuit.

Also included in the plug 30 is a plug cap 105 which is preferably connected to the plug 30 by a hinge 110 formed as a part of the plug 30. As shown in FIG. 3, the plug cap 105includes an opening 120 through which a wire is inserted. The wire is also inserted through a wire seal grommet 115. The plug cap 105 in combination with the wire seal grommet 115 assists in keeping oil and other contaminants from contacting the electrical connections within the receptacle 20 and plug 30, including the socket 95 and pin 40 connection. A plug wedge member 125 is inserted in the plug 30 and includes a pin opening 130 that permits the pin 40 to pass through the plug wedge member 125 and engage with the socket 95.

As noted above, when an electrical connector is used on internal combustion engines, they are often exposed to significant vibrations. The frequency of the vibrations are a function of many factors, one of which is the rotational speed of the engine. Those vibrations are potentially damaging to the connector if left undampened. A preferred embodiment of the present invention, however, includes a vibration dampening pad 135.

Figure 4:
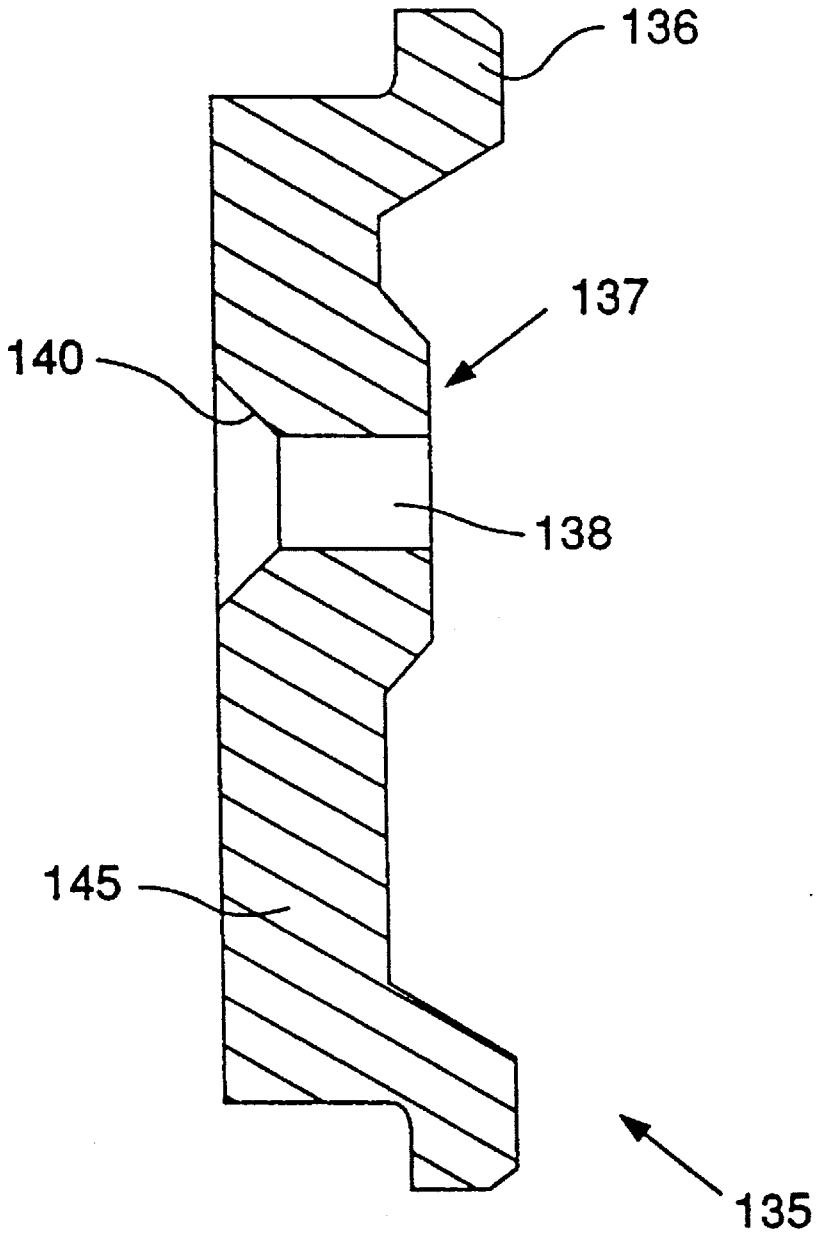
FIG. 4 is a cross-sectional view of a preferred embodiment of a dampening pad included in an embodiment of the present invention.

A preferred embodiment of the vibration dampening pad 135 included in the present invention is shown in cross section in FIG. 4. As shown in FIG. 4, the vibration dampening pad 135 preferably includes a raised lip 136 and a raised pin accepting area 137 that includes an electrical pin hole 138. The electrical pin hole 138 includes a countersink area 140 on a receptacle side 145 of the vibration dampening pad.

Although a preferred embodiment of the vibration dampening pad includes raised portions such as the lip 136, the present invention is not limited to the single configuration. To the contrary, the present invention includes all those electrical connectors with dampening pads that fall within the scope of the appended claims.

As shown in FIG. 3, the pin 40 is inserted through the electrical pin hole 138. The vibration dampening pad 135 is installed between the receptacle 20 and the plug 30. When the plug 30 is fully inserted in the receptacle 20 so that the securing notch 75 is engaged with the securing wedge 50 the plug 30 compresses the vibration dampening pad 135 against the receptacle 20. The vibration dampening pad 135 thereby exert a biasing force against the plug 30 to dampen external vibrations.

The vibration dampening pad 135 is preferably constructed from an oil resistant elastomer. Many of such materials are well known in the art. Any of those materials may be suitable for a given application. The spring constant of the dampening pad 135 can be changed by changing the material from which the pad 135 is made. Changing the material in turn changes the natural frequency of the receptacle 20 and plug 30 combination. Thus, although in certain environments it may not be possible to change the frequency of the vibrations affecting the electrical connector 10, it may be possible to change the natural frequency of the electrical connector 10 to differ from the vibration frequencies. In this manner, a preferred embodiment of the present invention helps prevent damage to the electrical connector that might be caused by vibrations of varying frequencies.

An embodiment of the present invention also allows the individual sockets 95 within the plug 30 to be replaced as necessary. Including the forcing member 80 with the socket holding tab 85 to secure the socket 95 in place permits individual sockets 95 to be replaced. Thus, if an individual socket 95 is damaged, it is not necessary to replace the entire plug 30. Instead, the forcing member 80 is depressed to release the socket holding tab 85 from the slot 90. The socket 95 can then be withdrawn and a new socket 95 can be replaced. In this manner, the expected life of the plug is extended.

We claim:

1. An electrical connector, comprising:

a plug;

a receptacle integral with a surface of an electrical component;

a vibration dampening pad installed between said plug and said receptacle;

an electrical pin connected to circuitry within said electrical component and extending from an inner surface of said receptacle;

a socket installed within said plug;

wherein said electrical pin engages said socket when said plug is installed in said socket;

wherein said plug includes a plug cap having a first and second opening; and a hinge connecting said plug cap to said plug.

2. The electrical connector according to claim 1 including:

a forcing member integral with said plug and biased in a first direction, said forcing member including a socket holding tab;

a slot formed in said socket; and wherein said socket holding tab engages said slot when said forcing member is biased in said first direction.

3. The electrical connector according to claim 1 including a wire grommet installed in said plug.

4. The electrical connector according to claim 3 including:

a first and second retaining notch on a surface of said plug cap;

a first and second retaining tab on a surface of said plug; and wherein said first and second retaining notch engage with said first and second retaining tab, respectively, when said plug cap 105 is moved from a first position to a second position.

5. The electrical connector according to claim 3, including:

a fastening bar integral with said plug, said fastening bar having a tab and a securing notch;

a securing wedge integral with said receptacle; and wherein said securing wedge engages said securing notch when said plug is inserted in said receptacle and said securing notch is disengaged upon pressing said tab of said fastening bar.

6. The electrical connector according to claim 5, wherein said vibration dampening pad is constructed from an oil resistant elastomer and wherein a natural frequency of said electrical connector can be changed by changing the material from which the vibration dampening pad is constructed.

7. The electrical connector according to claim 5, wherein said vibration dampening pad includes:

a raised lip along a periphery of said dampening pad;

a raised electrical pin accepting area; and an electrical pin hole included in said raised electrical pin accepting area.

8. An electrical connector, comprising:

a plug;

a receptacle integral with a surface of an electrical component;

a vibration dampening pad installed between said plug and said receptacle;

wherein said plug includes a plug cap having a first and second opening; and a hinge connecting said plug cap to said plug.

* * * * *